US009936739B2

(12) United States Patent
Smith

(10) Patent No.: US 9,936,739 B2
(45) Date of Patent: Apr. 10, 2018

(54) MULTI-PANEL SUPPORT FOUNDATION GARMENT

(71) Applicant: Lynx Enterprises LLC., New York, NY (US)

(72) Inventor: Cynthia A. Smith, Red Bank, NJ (US)

( * ) Notice: Subject to any disclaimer, the term of this patent is extended or adjusted under 35 U.S.C. 154(b) by 376 days.

(21) Appl. No.: 14/542,194

(22) Filed: Nov. 14, 2014

(65) Prior Publication Data

US 2016/0135512 A1 May 19, 2016

(51) Int. Cl.

| | |
|---|---|
| ***A41C 1/02*** | (2006.01) |
| ***A41C 5/00*** | (2006.01) |
| ***A41C 1/08*** | (2006.01) |
| *A41B 9/08* | (2006.01) |

(52) U.S. Cl.

CPC ..... *A41C 1/02* (2013.01); *A41C 1/08* (2013.01); *A41C 5/00* (2013.01); *A41B 9/08* (2013.01)

(58) Field of Classification Search

CPC ..... A61B 2300/20; A61B 2300/22; A61B 2500/40; A61B 2500/50; A61B 2500/52; A41D 2300/20; A41D 2300/22; A41C 1/00; A41C 1/003; A41C 1/02; A41C 1/04; A41C 1/08; A41C 1/10

USPC ..... 450/19, 20, 21, 7, 8, 34, 122, 123, 124, 450/74–76, 130, 131, 66, 116–118; 66/116–118

See application file for complete search history.

(56) References Cited

U.S. PATENT DOCUMENTS

| | | | | | |
|---|---|---|---|---|---|
| 2,327,310 | A | | 8/1943 | Lewis | |
| 2,608,688 | A | | 9/1952 | Leonard | |
| 2,651,778 | A | | 9/1953 | Wohlman | |
| 2,665,424 | A | * | 1/1954 | Barcley | A41C 1/00 450/115 |
| 2,707,280 | A | * | 5/1955 | Mayer | A41C 1/00 450/124 |
| 2,745,103 | A | | 5/1956 | Van Horne | |
| 2,977,959 | A | * | 4/1961 | Welsch | A41C 1/003 450/117 |
| 3,142,302 | A | | 7/1964 | Schonberg | |
| 3,212,504 | A | * | 10/1965 | Sheldon | A41C 1/10 450/104 |
| 3,238,945 | A | * | 3/1966 | Ambrose | A41C 1/02 450/124 |
| 3,255,756 | A | * | 6/1966 | Frei | A41C 1/02 450/124 |
| 3,507,286 | A | | 4/1970 | Salisky | |
| 4,538,615 | A | | 9/1985 | Pundyk | |

(Continued)

FOREIGN PATENT DOCUMENTS

WO WO-91/11121 8/1991

*Primary Examiner* — Gloria Hale

(57) ABSTRACT

A multi-panel support foundation garment includes a front panel, a rear panel, a left side panel, and a right side panel. The front panel is constructed of a first piece of non-stretch fabric having a larger degree of mechanical ease in a first direction than a second direction, the rear panel is constructed of a second piece of non-stretch fabric having a larger degree of mechanical ease in the first direction than the second direction, the left side panel is constructed of a first piece of stretch fabric having a larger degree of elastic stretch in the first direction than the second direction, and the right side panel constructed of a second piece of stretch fabric having a larger degree of elastic stretch in the first direction than the second direction.

20 Claims, 20 Drawing Sheets

(56) References Cited

U.S. PATENT DOCUMENTS

| | | | | |
|---|---|---|---|---|
| 4,983,140 | A | 1/1991 | Gimble | |
| 5,182,815 | A * | 2/1993 | Young | A41B 9/004 2/228 |
| 7,238,080 | B2 | 7/2007 | Gimble | |
| 2016/0135512 | A1 * | 5/2016 | Smith | A41C 1/02 450/131 |

* cited by examiner

MULTI-PANEL SUPPORT FOUNDATION GARMENT

FIELD

The present invention relates to improvements in support foundation garments such as control top garments, bodysuits, girdles, panty girdles, swimwear, and other such garments as contact the wearers abdomen and lower back. It is desirable to the wearer to have a slimmer abdominal profile or to have support for the muscles and connective tissue of the lower back.

BACKGROUND

Traditional foundation garments include a plurality of fabric pieces that are sewn together or otherwise coupled to form the article of clothing. Such fabric pieces may be each cut from a fabric that stretches in multiple directions (e.g., to form a compression garment, etc.). Foundation garments formed of pieces of fabric that stretch in multiple directions may compress the body of the wearer to an uncomfortable degree. Despite this lack of comfort, sewing together fabric pieces that stretch in multiple directions remains the primary method for constructing foundation garments.

SUMMARY

One embodiment relates to a multi-panel support foundation garment that includes a front panel, a rear panel, a left side panel, and a right side panel. The front panel is constructed of a first piece of non-stretch fabric having a larger degree of mechanical ease in a first direction than a second direction, the rear panel is constructed of a second piece of non-stretch fabric having a larger degree of mechanical ease in the first direction than the second direction, the left side panel is constructed of a first piece of stretch fabric having a larger degree of elastic stretch in the first direction than the second direction, and the right side panel constructed of a second piece of stretch fabric having a larger degree of elastic stretch in the first direction than the second direction. The left side panel connects a first edge of the front panel to a first edge of the rear panel, and the right side panel connects a second edge of the front panel to a second edge of the rear panel.

Another embodiment relates to a method for constructing a multi-panel support foundation garment that includes fabricating a front panel from a first piece of non-stretch fabric such that the front panel exhibits a larger degree of mechanical ease in a first direction than a second direction, fabricating a rear panel from a second piece of non-stretch fabric such that the rear panel exhibits a larger degree of mechanical ease in the first direction than the second direction, connecting a first edge of the front panel to a first edge of the rear panel with a first side panel exhibiting a larger degree of elastic stretch in the first direction than the second direction, and connecting a second edge of the front panel to a second edge of the rear panel with a second side panel exhibiting a larger degree of elastic stretch in the first direction than the second direction.

Yet another embodiment relates to a multi-panel support foundation garment that includes a front panel defining a longitudinal axis, the front panel including a first piece of non-stretch fabric having a first primary ease direction, a rear panel including of a second piece of non-stretch fabric having a second primary ease direction, and a side panel coupling the front panel to the rear panel, the side panel including a first piece of stretch fabric having a primary stretch direction. The first piece of non-stretch fabric is positioned such that the first primary ease direction extends laterally across the longitudinal axis, the second piece of non-stretch fabric is positioned such that the second primary ease direction extends laterally across the longitudinal axis, and the first piece of stretch fabric is positioned such that the primary stretch direction extends laterally across the longitudinal axis.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The invention will become more fully understood from the following detailed description taken in conjunction with the accompanying drawings, wherein like reference numerals refer to like elements, in which.

DETAILED DESCRIPTION

Figure 1:
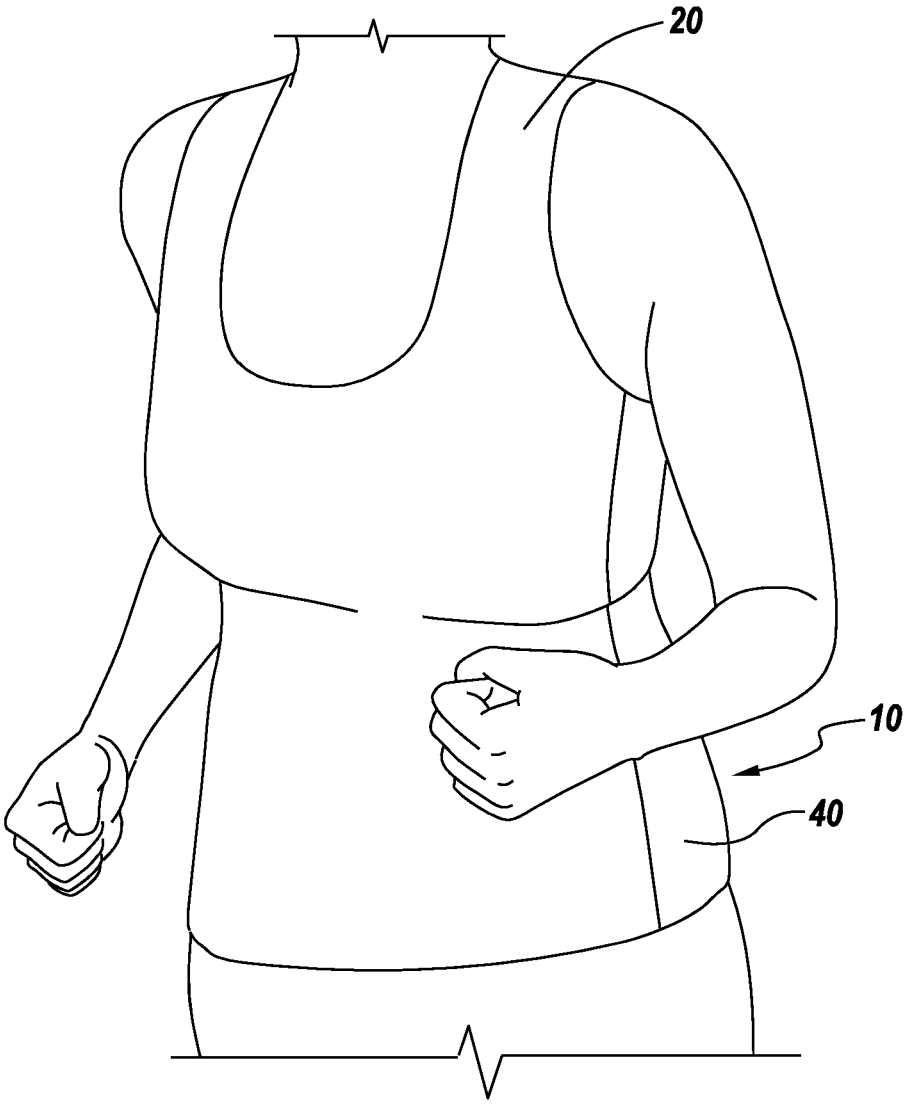
FIG. 1 is a front perspective view of a person wearing a multi-panel support garment, according to one embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

According to the embodiment shown in FIGS. 1-5, a multi-panel support foundation garment, shown as garment 10, includes a plurality of fabric panels having different characteristics. Garment 10 provides the wearer with a greater degree of comfort than garments commonly found in the marketplace without sacrificing the normal function of a support foundation garment, which is to confine and minimize the appearance of the stationary fatty portions of the wearer's body (e.g., along the lower back, along the lower, middle, or upper portions of the stomach, etc.) and provide support to muscles and connective tissue.

As shown in FIGS. 1-5, the plurality of fabric panels of garment 10 are at least one of arranged, molded, sewn, shaped, formed, cut, and tailored to form a tank top. According to other embodiments, the plurality of fabric panels of garment 10 are at least one of arranged, molded, sewn, shaped, formed, cut, and tailored to form a t-shirt, a pair of pants, a dress, a skirt, a jacket, a unitard, or still another article of clothing. Garment 10 may be at least one of arranged, molded, sewn, shaped, formed, cut, and tailored to fit men, women, or both men and women. According to the embodiment shown in FIGS. 1-5, garment 10 includes a front panel, shown as front panel 20, a rear panel, shown as rear panel 30, a left side panel, shown as left side panel 40, and a right side panel, shown as right side panel 50. Front panel 20 and rear panel 30 may have the same shape or different shapes, according to various embodiments.

Garment 10 may be at least one of arranged, molded, sewn, shaped, formed, cut, and tailored to fit the wearer more appropriately when worn in an intended configuration (e.g., with front panel 20 disposed along the stomach of the wearer and rear panel 30 disposed along the back of the wearer, etc.). Accordingly, the terms "front," "rear," "left," and "right" may be relative to the portions of a person wearing garment 10 as intended. Garment 10 may define a longitudinal direction or axis 12. In one embodiment, garment 10 is configured such that the longitudinal direction 12 extends along a height direction of the person wearing garment 10 (i.e., a length of garment 10 extends along a portion of the height of the person wearing garment 10, etc.). In other embodiments, at least one of front panel 20 and rear panel 30 define longitudinal direction 12 (e.g., in a direction along which a length of front panel 20 or rear panel 30 that is greater than a width of the front panel 20 or rear panel 30 is positioned, in a direction that extends long a portion of the height of the person wearing garment 10 as intended, etc.).

As shown in FIGS. 1-5, the plurality of panels include flat portions and shaped portions. The shaped portions may be at least one of arranged, molded, sewn, formed, cut, and tailored to cooperate with the other panels to fit the person wearing garment 10. In other embodiments, the plurality of panels include only flat portions, only shaped portions, or still another combination of features.

Front panel 20, rear panel 30, left side panel 40, and right side panel 50 may be manufactured (e.g., arranged, molded, sewn, shaped, formed, cut, tailored, etc.) from a plurality of fabrics. According to one embodiment, front panel 20, rear panel 30, left side panel 40, and right side panel 50 are manufactured from at least two different fabric materials. Front panel 20 and rear panel 30 are manufactured from a first fabric material, while left side panel 40 and right side panel 50 are manufactured from a second fabric material different from the first fabric material, according to one embodiment.

Figure 2:
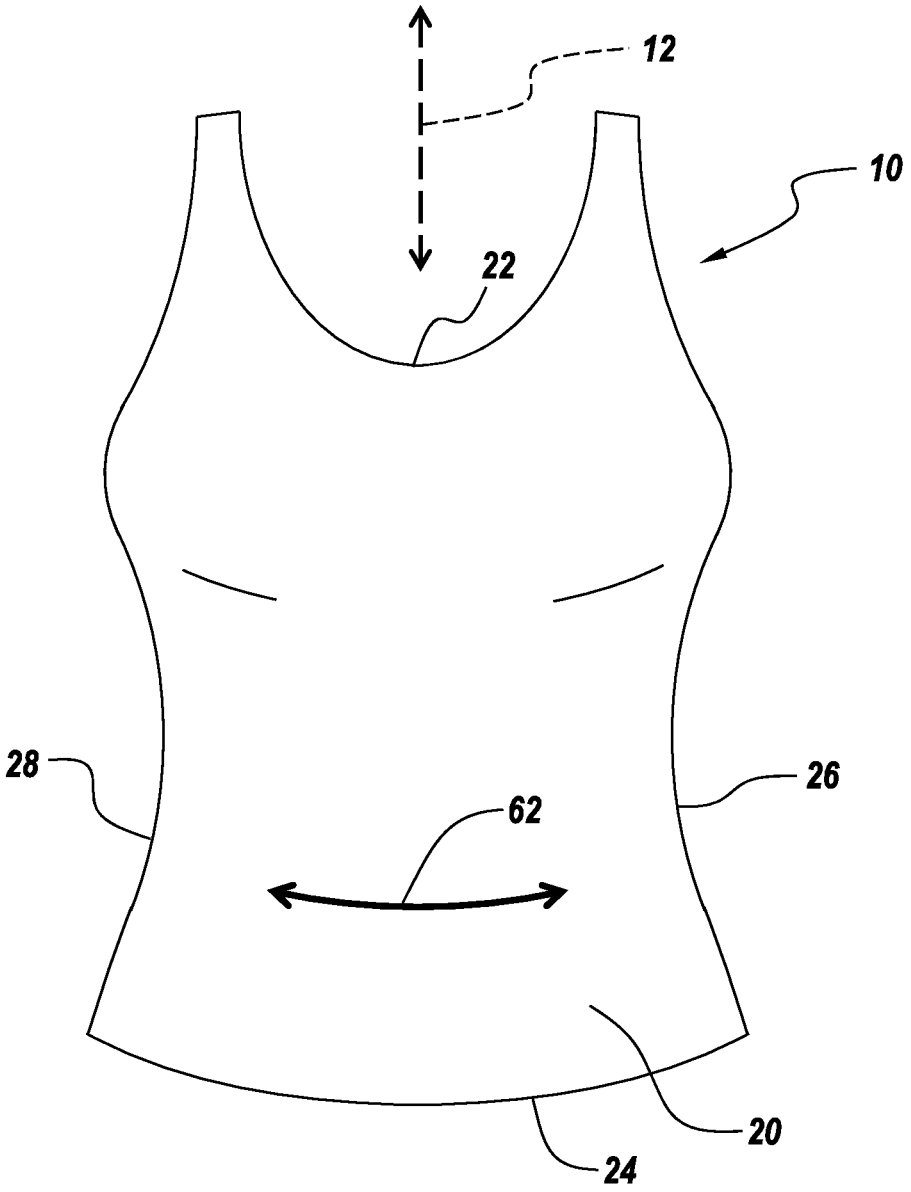
FIG. 2 is a front elevation view of the multi-panel support garment of FIG. 1.
Figure 3:
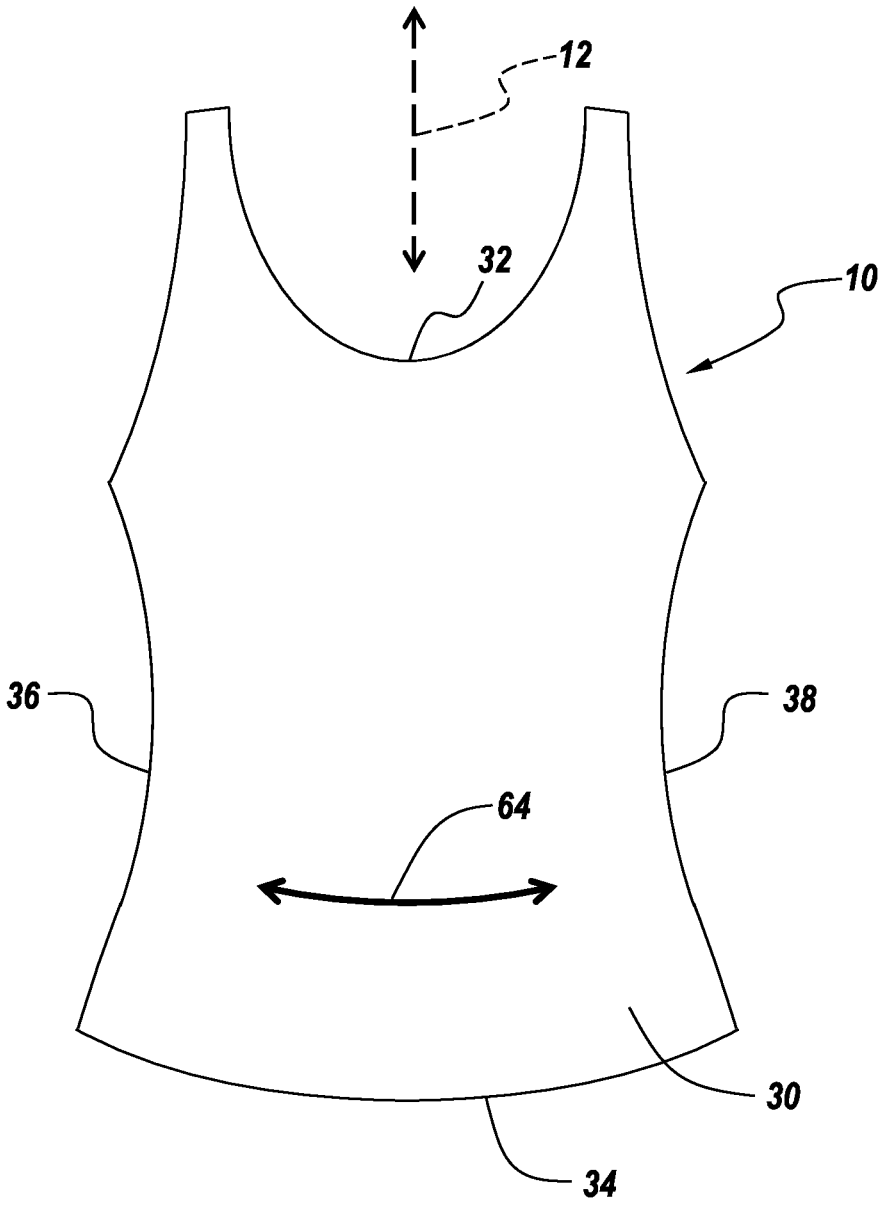
FIG. 3 is a rear elevation view of the multi-panel support garment of FIG. 1.
Figure 4:
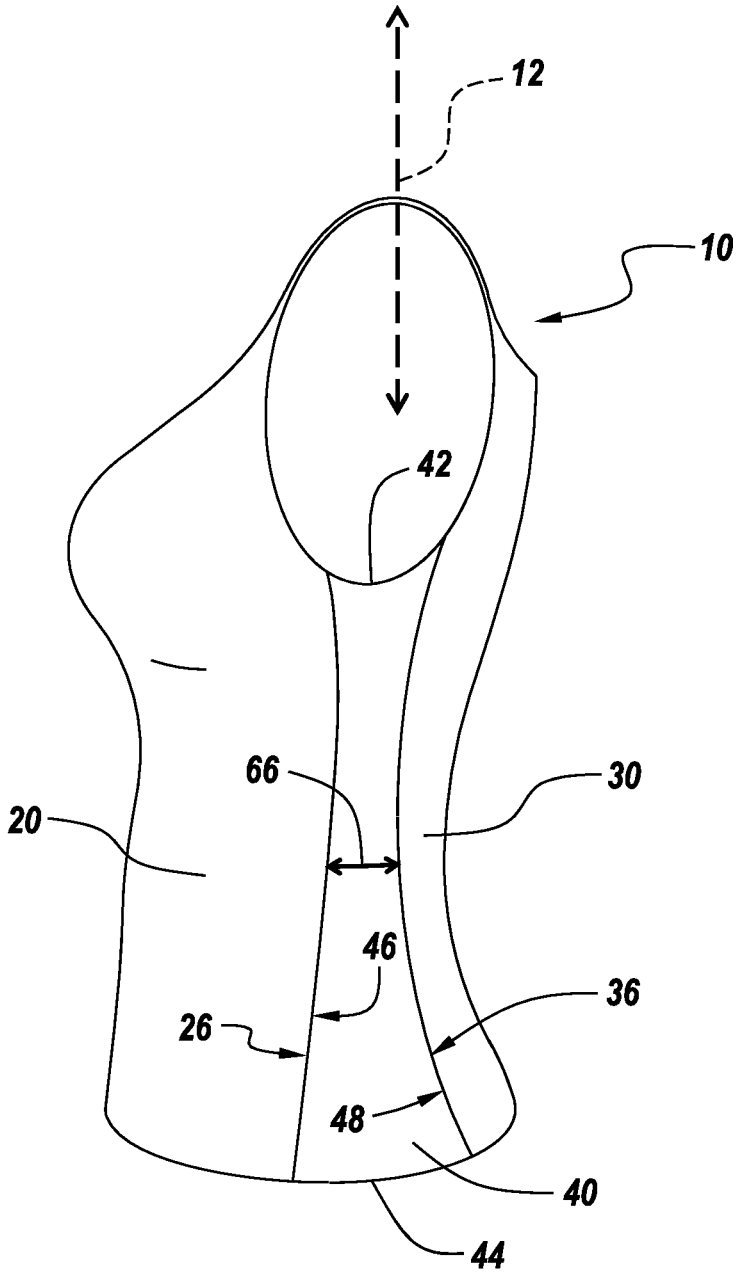
FIG. 4 is a left side elevation view of the multi-panel support garment of FIG. 1.
Figure 5:
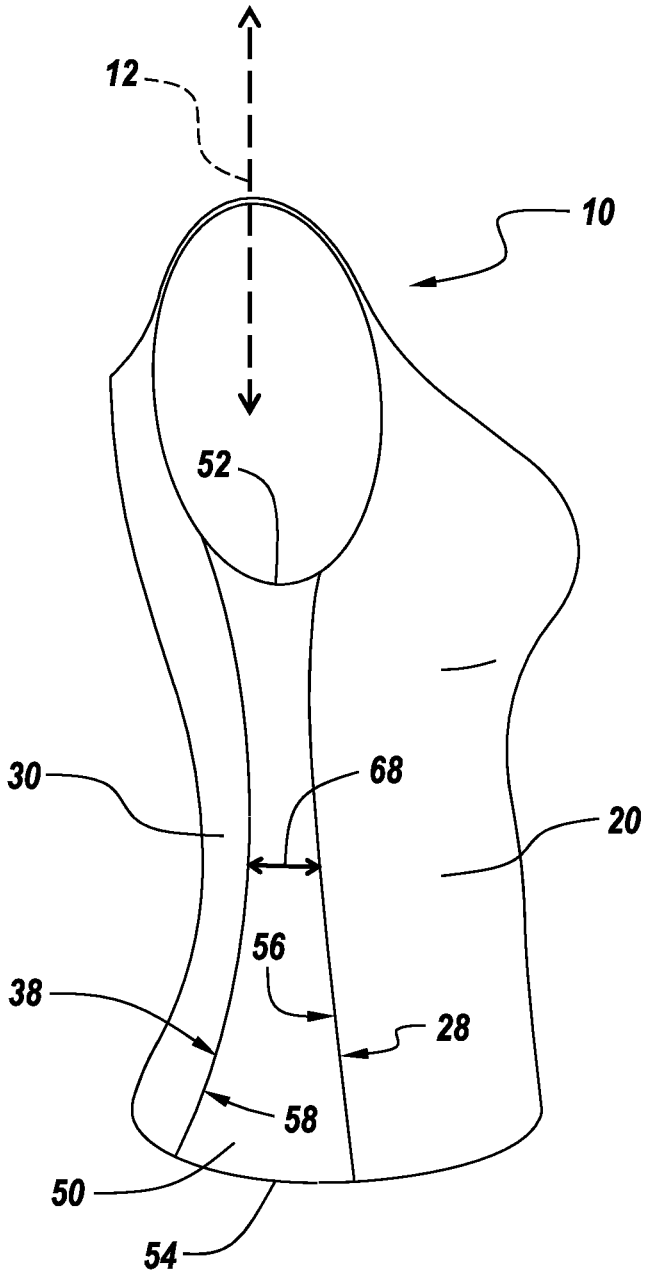
FIG. 5 is a right side elevation view of the multi-panel support garment of FIG. 1.

As shown in FIGS. 2-3, front panel 20 has a first edge, shown as top edge 22, a second edge, shown as bottom edge 24, a third edge, shown as left side edge 26, and a fourth edge, shown as right side edge 28, while rear panel 30 has a first edge, shown as top edge 32, a second edge, shown as bottom edge 34, a third edge, shown as left side edge 36, and a fourth edge, shown as right side edge 38. As shown in FIGS. 4-5, left side panel 40 has a first edge, shown as top edge 42, a second edge, shown as bottom edge 44, a third edge, shown as front edge 46, and a fourth edge, shown as rear edge 48, while right side panel 50 has a first edge, shown as top edge 52, a second edge, shown as bottom edge 54, a third edge, shown as front edge 56, and a fourth edge, shown as rear edge 58. In other embodiments, at least one of front panel 20, rear panel 30, left side panel 40, and right side panel 50 have more or fewer edges.

Referring still to FIGS. 2-5, top edge 22 of front panel 20 is coupled (e.g., sewn, thermally bonded, adhesively bonded, ultrasonically seamed, integrally woven, integrally knit, otherwise integrally formed, etc.) to top edge 32 of rear panel 30. Front panel 20 and rear panel 30 may define a pair of straps that are coupled together. In other embodiments, front panel 20 and rear panel 30 define a pair of sleeves that are coupled together. In still other embodiments, top edge 22 of front panel 20 is still otherwise coupled to top edge 32 of rear panel 30. In yet other embodiments, top edge 22 of front panel 20 is not directly coupled to top edge 32 of rear panel 30. Left side panel 40 and right side panel 50 couple front panel 20 to rear panel 30, according to one embodiment. As shown in FIG. 4, left side edge 26 of front panel 20 is coupled to front edge 46 of left side panel 40, and left side edge 36 of rear panel 30 is coupled to rear edge 48 of left side panel 40. As shown in FIG. 5, right side edge 28 of front panel 20 is coupled to front edge 56 of right side panel 50, and right side edge 38 of rear panel 30 is coupled to rear edge 58 of right side panel 50. According to one embodiment, front panel 20, rear panel 30, left side panel 40, and right side panel 50 each include a single continuous piece of fabric. According to another embodiment, at least one of front panel 20, rear panel 30, left side panel 40, and right side panel 50 includes a plurality of contiguous pieces of fabric that are coupled together (e.g., sewn, thermally bonded, adhesively bonded, ultrasonically seamed, integrally woven, integrally knit, otherwise integrally formed, etc.) and cooperatively form the panel of garment 10.

Front panel 20 and rear panel 30 may be shaped to suit the particular needs of the individual design of garment 10. In one embodiment, at least one of front panel 20 and rear panel 30 are trapezoids. In another embodiment, at least one of front panel 20 and rear panel 30 are rectangular. In another embodiment, at least one of front panel 20 and rear panel 30 are curvilinear triangular. In another embodiment, at least one of front panel 20 and rear panel 30 are rhombuses. In another embodiment, at least one of front panel 20 and rear panel 30 are oval shaped. In yet another embodiment, at least one of front panel 20 and rear panel 30 are ellipses. Front panel 20 and rear panel 30 may have different shapes but still form portions of the same garment 10.

The fabrics of garment 10 (e.g., the fabrics from which at least one of front panel 20, rear panel 30, left side panel 40, and right side panel 50 are at least one of arranged, molded, sewn, shaped, formed, cut, and tailored, etc.) may include a plurality of fibers that are woven, knitted, felted, or otherwise arranged into a structure that forms the material. The plurality of fibers may include a single constituent material (e.g., cotton, rayon, Lycra, Dorlastan, another spandex material, another elastane material, another synthetic material, another natural material, etc.) or may include a blend of multiple constituent materials. Garment 10 includes fabrics having a certain degree of elastic stretch, where the fabric elongates when a force is applied due to deformation (e.g., elastic deformation, etc.) of the fibers themselves (e.g., deformation within the elastic region of the fibers when a force or a stress below the yield strength of the fibers is applied, etc.). The fibers resist the force (e.g., the pull, etc.) and return the fabric to the pre-pull state when the force is released.

The fabrics of garment 10 may have a certain degree of mechanical ease (i.e., mechanical give, etc.), where the fabric elongates when a force is applied due to movement of the fibers within the structure of the material. The mechanical ease of the fabrics varies based on the arrangement of the fibers within the structure of the material (e.g., warp and weft density, weave, etc.) and the conditions under which the fabric was produced (e.g., speed of weaving, warp insertion rate, warp and weft tension, etc.). In one embodiment, the mechanical ease does not resist pull in the same way (e.g., does not have the same type of rebound, does not have the same pull profile of rebound, etc.) as the elastic stretch associated with the fibers themselves. Rather, the mechanical ease allows the fibers that make up the fabric to move in and out of the empty spaces between the fibers.

The elongation of the fabrics (e.g., due to the mechanical ease, due to the elastic deformation of the fibers themselves, due to the both the mechanical ease and the elastic deformation of the fibers themselves, etc.) may be quantified in terms of a stretch factor. The stretch factor may be equal to the pre-stretched dimension of the fabric subtracted from the stretched dimension of the fabric (e.g., with a force applied that produces sub-yield strength stresses, etc.), with the resulting quantity thereafter divided by the pre-stretched dimension of the fabric.

Stretch fabrics may have both mechanical ease and elastic stretch or primarily only elastic stretch while non-stretch fabrics may have primarily only mechanical ease. In other embodiments, stretch fabrics have a greater degree of elastic stretch than mechanical ease while non-stretch fabrics have a greater degree of mechanical ease than elastic stretch. In still other embodiments, stretch fabrics have a stretch factor at least equal to a threshold (e.g., more than zero percent, at least 2%, at least 5%, at least 9%, at least 50%, etc.) while non-stretch fabrics have a stretch factor of less than the threshold (e.g., zero percent, less than 2%, less than 5%, less than 9%, less than 50%, etc.). In yet other embodiments, stretch fabrics are those that contain more than a threshold percentage of elastic fibers (e.g., more than zero percent, at least 2%, at least 5%, at least 9%, at least 50%, etc.) while non-stretch fabrics contain less than the threshold percentage of elastic fibers (e.g., zero percent, less than 2%, less than 5%, less than 9%, less than 50%, etc.). In still other embodiments, non-stretch fabrics do not rebound in the same way as stretch fabrics (e.g., rebound to a lesser extent than stretch fabrics, rebound with less force than stretch fabrics, rebound with different force-displacement profiles than stretch fabrics, etc.).

According to one embodiment, front panel 20 and rear panel 30 each include non-stretch fabrics while left side panel 40 and right side panel 50 each include stretch fabrics. The non-stretch panels in the front of garment 10 (i.e., front panel 20) and in the back of garment 10 (i.e., rear panel 30) provide the wearer with a flatter abdominal profile and support of the soft tissue of the lower back, as well as provide relief from the sensation of compression. According to another embodiment, front panel 20 includes a non-stretch fabric while rear panel 30, left side panel 40, and right side panel 50 include stretch fabrics. Garment 10 may include still other combinations of stretch and non-stretch panels, according to various other embodiments.

Garment 10 including such combinations of stretch and non-stretch fabrics provides the wearer with a greater degree of comfort than garments commonly found in the marketplace without sacrificing the normal function of a support foundation garment. By way of example, the panels of garment 10 may provide support without making the wearer feel that their body is being too tightly compressed, which may occur with garments having panels that each include a stretch fabric. Garment 10 may thereby make it easier for the wearer to breathe, move, and eat comfortably. Garment 10 may be particularly appealing to wearers who want to experience the benefits of foundation garments but feel that they cannot tolerate the strong compression of traditional garments.

The fabrics of garment 10 may be anisotropic (i.e., may have properties that vary with direction, etc.). By way of example, the fabrics may have at least one of a mechanical ease and an elastic stretch that varies based on the direction of the applied force. The stretch fabrics of garment 10 may have an elastic stretch that is greater in a first direction (e.g., a lengthwise direction, a cross-grain direction, etc.) than in a second direction (e.g., a widthwise direction, a grain direction, etc.). The first direction may be angularly offset relative to (e.g., perpendicular to, etc.) the second direction. The first direction (i.e., the direction along which the greater amount of elastic stretch occurs, etc.) may define a primary stretch direction of the stretch fabric. Stretch fabrics having a primary stretch direction may have elastic stretch that occurs primarily in a single direction. This characteristic can be observed by physical manipulation of the fabric in both the first and second directions.

The non-stretch fabrics of garment 10 may have a mechanical ease that is greater in a first direction (e.g., a lengthwise direction, a cross-grain direction, etc.) than in a second direction (e.g., a widthwise direction, a grain direction, etc.). The first direction may be angularly offset relative to (e.g., perpendicular to, etc.) the second direction. The first direction (i.e., the direction along which the greater amount of mechanical ease occurs, etc.) may define a primary ease direction of the non-stretch fabric. Non-stretch fabrics having a primary ease direction may have mechanical ease that occurs primarily in a single direction. This characteristic can be observed by physical manipulation of the fabric in both the first and second directions.

According to one embodiment, garment 10 includes fabric panels arranged such that the primary stretch directions and primary ease directions of the fabric panels are oriented horizontally around the body of the wearer. According to the embodiment shown in FIGS. 2-5, front panel 20 has a primary ease direction 62, rear panel 30 has a primary ease direction 64, left side panel 40 has a primary stretch direction 66, and right side panel 50 has a primary stretch direction 68. In one embodiment, primary ease direction 62, primary ease direction 64, primary stretch direction 66, and primary stretch direction 68 are positioned horizontally (e.g., relative to a vertical direction defined by the length of garment 10, relative to a vertical direction defined by the height of the wearer, relative to an axial direction of the wearer, relative to an absolute vertical when garment 10 is positioned in an orientation intended for use, etc.). By way of example, the fabrics of front panel 20, rear panel 30, left side panel 40, and right side panel 50 may be positioned such that the primary ease directions and primary stretch directions extend laterally across longitudinal direction 12. Primary ease direction 62, primary ease direction 64, primary stretch direction 66, and primary stretch direction 68 may each extend within a plane that is orthogonal to longitudinal direction 12, a centerline of garment 10, a height of the wearer dressed in garment 10, an absolute vertical direction, or still another direction. In other embodiments, at least one of primary ease direction 62, primary ease direction 64, primary stretch direction 66, and primary stretch direction 68 are positioned horizontally or extend within a plane that is orthogonal to longitudinal direction 12, a centerline of garment 10, a height of the wearer dressed in garment 10, an absolute vertical direction, or still another direction.

Garment 10 having front panel 20, rear panel 30, left side panel 40, and right side panel 50 with such an arrangement of primary ease directions and primary stretch directions (e.g., with the primary ease direction and primary stretch directions oriented horizontally, etc.) provides a greater degree of comfort for the wearer relative to traditional foundation garments. Garment 10 may provide a greater degree of comfort for the wearer because the combination of stretch and non-stretch panels having such an arrangement of primary ease directions and primary stretch directions facilitates a more comfortable expansion of the abdomen during breathing. Garment 10 may also provide a greater degree of comfort for the wearer because the combination of stretch and non-stretch panels having such an arrangement of primary ease directions and primary stretch directions facilitates movement of the torso as the wearer moves, eats, or undertakes still another activity.

The degree of comfort provided by garment 10 (e.g., during movement, during eating, during breathing, etc.) with non-stretch panels having primary ease directions in the horizontal direction is greater than the degree of comfort garment 10 would provide if the primary ease directions were oriented vertically (e.g., a direction perpendicular to the directions shown in FIGS. 2-3, etc.) or eliminated entirely. The degree of comfort provided by garment 10 (e.g., during movement, during eating, during breathing, etc.) with stretch panels having primary stretch directions in the horizontal direction is greater than the degree of comfort garment 10 would provide if the primary stretch directions were oriented vertically (e.g., a direction perpendicular to the directions shown in FIGS. 2-3, etc.) or eliminated entirely. In one embodiment, left side panel 40 and right side panel 50 exert an elastic pull on front panel 20 and rear panel 30. The elastic pull may facilitate at least one of confinement of the wearer, reduction in the appearance of the stationary fatty portions of the wearer's body, and support of the wearer's muscles and connective tissue by front panel 20 and rear panel 30. Garment 10 may have a left side panel 40 and a right side panel 50 that are at least one of arranged, molded, sewn, shaped, formed, cut, and tailored to exert the elastic pull on front panel 20 and rear panel 30.

Garment 10 includes panels having a target level of mechanical ease, according to one embodiment. The amount of mechanical ease in the non-stretch panels impacts the level of confinement felt by the wearer. The amount of mechanical ease in the non-stretch panels may also impact the reduction in the appearance of stationary fatty portions of the wearer's body and the level of support provided to muscles and connective tissue. By way of example, a greater amount of mechanical ease may reduce the level of confinement felt by the wearer, reduce the appearance of fatty portions of the wearer's body to a lesser degree, and provide less support to muscles and connective tissue. By way of another example, a reduced amount of mechanical ease may increase the level of confinement felt by the wearer, reduce the appearance of fatty portions of the wearer's body to a greater degree, and provide more support to muscles and connective tissue.

In one embodiment, the non-stretch panels of garment 10 (e.g., front panel 20, rear panel 30, etc.) have the target level of mechanical ease. The target level of mechanical ease may balance at least one of a desired reduction in the appearance of stationary fatty portions of the wearer's body and a desired level of support provided to muscles and connective tissue with a desired level of confinement. The target level of mechanical ease may thereby balance the comfort of the wearer and the desire for confinement and minimization of the appearance of the stationary fatty portions of the wearer's body and the support to the muscles. In another embodiment, the target level of mechanical ease produces at least one of a maximum reduction in the appearance of stationary fatty portions of the wearer's body and a maximum level of support for muscles and connective tissue along with a maximum level of confinement that is tolerable for the wearer.

In one embodiment, the non-stretch panels of garment 10 (e.g., front panel 20, rear panel 30, etc.) include a single layer of fabric that has the target level of mechanical ease. By way of example, at least one of the arrangement of the fibers within the structure of the material and the conditions under which the fabric was produced may be specified to provide the target level of mechanical ease. In another embodiment, the non-stretch panels of garment 10 include a plurality of fabric layers that together provide the target level of mechanical ease. By way of example, two fabric layers each having half of the target level of mechanical ease may together provide the target level of mechanical ease. By way of another example, two fabric layers each having a mechanical ease greater than half of the target level of mechanical ease may together provide the target level of mechanical ease (i.e., two pieces of fabric may be combined to provide a composite having a level of mechanical ease that is greater than or less than the sum of their individual mechanical eases, etc.). Accordingly, it is possible to decrease the amount of mechanical ease in the non-stretch panels of garment 10 by utilizing multiple layers of fabric that together provide a reduced amount of mechanical ease in addition to utilizing a fabric with a reduced amount of mechanical ease.

Garment 10 includes panels having a target level of elastic stretch, according to one embodiment. The amount of elastic stretch in the stretch panels impacts the level of confinement felt by the wearer. The amount of elastic stretch in the stretch panels may also impact the reduction in the appearance of stationary fatty portions of the wearer's body and the level of support provided to muscles and connective tissue. By way of example, a greater amount of elastic stretch may reduce the level of confinement felt by the wearer, reduce the appearance of fatty portions of the wearer's body to a lesser degree, and provide less support to muscles and connective tissue. By way of another example, a reduced amount of elastic stretch may increase the level of confinement felt by the wearer, reduce the appearance of fatty portions of the wearer's body to a greater degree, and provide more support to muscles and connective tissue.

In one embodiment, the stretch panels of garment 10 (e.g., left side panel 40, right side panel 50, etc.) have the target level of elastic stretch. The target level of elastic stretch may balance at least one of a desired reduction in the appearance of stationary fatty portions of the wearer's body and a desired level of support provided to muscles and connective tissue with a desired level of confinement. The target level of elastic stretch may thereby balance the comfort of the wearer and the desire for confinement and minimization of the appearance of the stationary fatty portions of the wearer's body and the support to the muscles. In another embodiment, the target level of elastic stretch produces at least one of a maximum reduction in the appearance of stationary fatty portions of the wearer's body and a maximum level of support for muscles and connective tissue along with a maximum level of confinement that is tolerable for the wearer.

In one embodiment, the stretch panels of garment 10 (e.g., left side panel 40, right side panel 50, etc.) include a single layer of fabric that has the target level of elastic stretch. By way of example, at least one of the constituent material or constituent materials, the fiber thicknesses, and the relative orientations of the fibers may be specified to provide the target level of elastic stretch. In another embodiment, the stretch panels of garment 10 include a plurality of fabric layers that together provide the target level of elastic stretch. By way of example, two fabric layers each having half of the target level of elastic stretch may together provide the target level of elastic stretch. Accordingly, it is possible to increase the amount of elastic stretch in the stretch panels of garment 10 by utilizing multiple layers of fabric that together provide a greater amount of elastic stretch in addition to utilizing a fabric with a greater amount of elastic stretch.

Garment 10 reduces the appearance of stationary fatty portions of the wearer's body and supports the wearer's muscles and connective tissue to a greater extent than available products, all while providing a desired level of confinement (i.e., without inducing an uncomfortable amount of compression, etc.). Particularly, garment 10 has a combination and orientation of the panels (e.g., front panel 20, rear panel 30, left side panel 40, right side panel 50, etc.) that reduces the appearance of stationary fatty portions of the wearer's body and supports the wearer's muscles and connective tissue without the wearer feel that their body is too tightly compressed.

The uncomfortable sensation of tight compression is associated with traditional multi-panel foundation garments that are constructed entirely of a stretch fabric, with different areas of the garment constructed of a stretch fabric with multiple directions of stretch (e.g., multi-panel foundation garments where the front and back panels stretch in the horizontal direction and the two side panels connecting the front and back panels stretch in the diagonal, or bias, direction, etc.). The uncomfortable sensation of tight compression is also associated with garments having (a) front center panels made of either non-stretch or stretch fabrics with the mechanical or elastic stretch in the vertical direction only, (b) garments having back panels made of a fabric with elastic stretch or mechanical ease arranged in either the vertical direction or in both the vertical and horizontal directions, and (c) garments where the front panel and side panels are constructed of a stretch fabric with the elastic stretch in both the vertical and horizontal directions and the back panel is constructed of a stretch fabric with the elastic stretch only in the vertical direction (e.g., particularly those disclosing that portions of both the front panel and back panel are each superimposed with a piece of a non-stretch material, eliminating all elastic and mechanical stretch, such that these superimposed sections of the garment resist the expansion of the abdomen in any direction, and any natural expansion of the body is redirected to the upper abdomen, etc.).

In one embodiment, a stretch panel of garment 10 (e.g., left side panel 40, right side panel 50, etc.) includes a target combination of fibers that are made from different constituent materials. By way of example, the fabric from which the stretch panel of garment 10 is at least one of arranged, molded, sewn, shaped, formed, cut, and tailored may include a blend of elastic fibers (e.g., fibers having a stretch factor of more than zero percent, at least 2%, at least 5%, at least 9%, at least 50%, etc.) and non-elastic fibers (e.g., fibers having a stretch factor of zero percent, less than 2%, less than 5%, less than 9%, less than 50%, etc.). According to one embodiment, the stretch panel of garment 10 has the target combination of fibers that includes no less than 5% and no greater than 40% elastic fibers. In addition to utilizing a fabric with the target combination of fibers (e.g., a target percentage of elastic fibers, etc.), the stretch panel of garment 10 may include a plurality of layers of fabric each having a lower percentage of elastic fibers. The plurality of layers may cooperate such that the stretch panel of garment 10 has the target combination of fibers. A stretch panel of garment 10 may thereby have an increased percentage of elastic fibers due to at least one of an increased percentage of elastic fibers within the fabric itself and the use of multiple layers of fabric each having a lower percentage of elastic fibers.

A stretch panel of garment 10 having the target combination of fibers provides a preferred level of confinement while reducing the appearance of the stationary fatty portions of the wearer's body and enhancing the support to muscles and connective tissue. In one embodiment, a greater percentage of elastic fibers provides a greater reduction in the appearance of the stationary fatty portions of the wearer's body and improved support to muscles and connective tissue, and a reduced percentage of elastic fibers provides a smaller reduction in the appearance of the stationary fatty portions of the wearer's body and less support to muscles and connective tissue but also reduces confinement. A stretch panel of garment 10 having the target combination of fibers improves the wearer's level of comfort. In one embodiment, a greater percentage of elastic fibers provides a greater level of comfort for the wearer, and a reduced percentage of elastic fibers offers somewhat less comfort. A stretch panel of garment 10 having the target combination of fibers offers improved confinement, minimization of the appearance of the stationary fatty portions of the wearer's body, and support to muscles and connective tissue without sacrificing the comfort of the wearer.

Figure 6A:
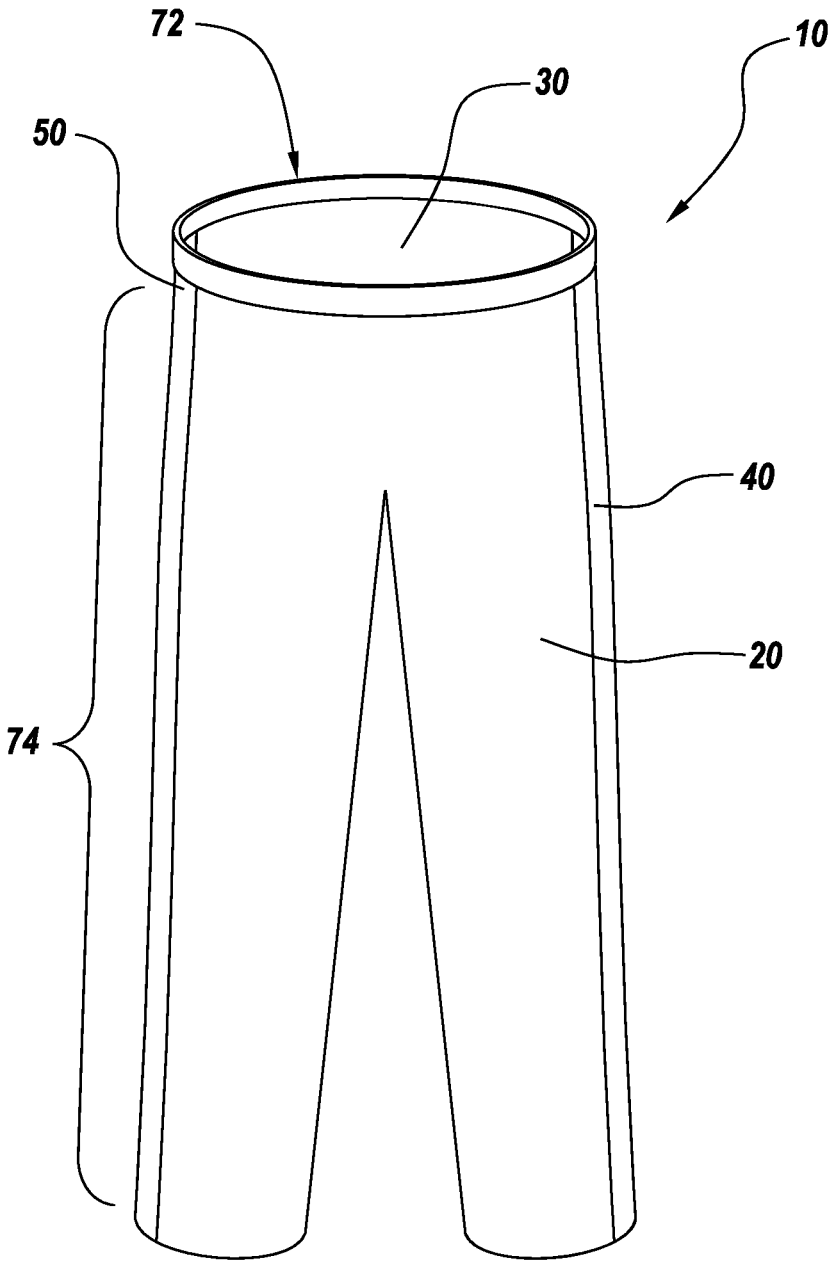
FIGS. 6A-6C are front perspective views of a multi-panel support garment provided as part of a pair of pants, according to various embodiments.

Referring next to the embodiments shown in FIGS. 6A-10B, the plurality of fabric panels of garment 10 are at least one of arranged, molded, sewn, shaped, formed, cut, and tailored to form various articles of clothing. As shown in FIGS. 6A-6C, garment 10 is provided as part of a pair of pants (e.g., athletic pants, etc.). As shown in FIGS. 6D-6E, garment 10 is provided as part of a pair of shorts (e.g., athletic shorts, etc.). While shown provided as part of a pair of pants and a pair of shorts, it should be understood that garment 10 may be provided as part of a pair of capris, another type of foundation wear, or other legwear. According to the embodiment shown in FIGS. 7A-7C, garment 10 is provided as part of a swimsuit. According to the embodiment shown in FIGS. 8A-8B, garment 10 is provided as part of a unitard. According to the embodiment shown in FIGS. 9A-9B, garment 10 is provided as part of a skirt. According to the embodiment shown in FIGS. 10A-10B, garment 10 is provided as part of a pair of briefs, shown as a pair of high-waist briefs. Garment 10 of FIGS. 6A-10B may include fabric panels arranged such that the primary stretch directions and primary ease directions of the fabric panels are oriented horizontally around the body of the wearer, according to one embodiment, thereby providing a greater degree of comfort for the wearer relative to traditional foundation garments.

Figure 6B:
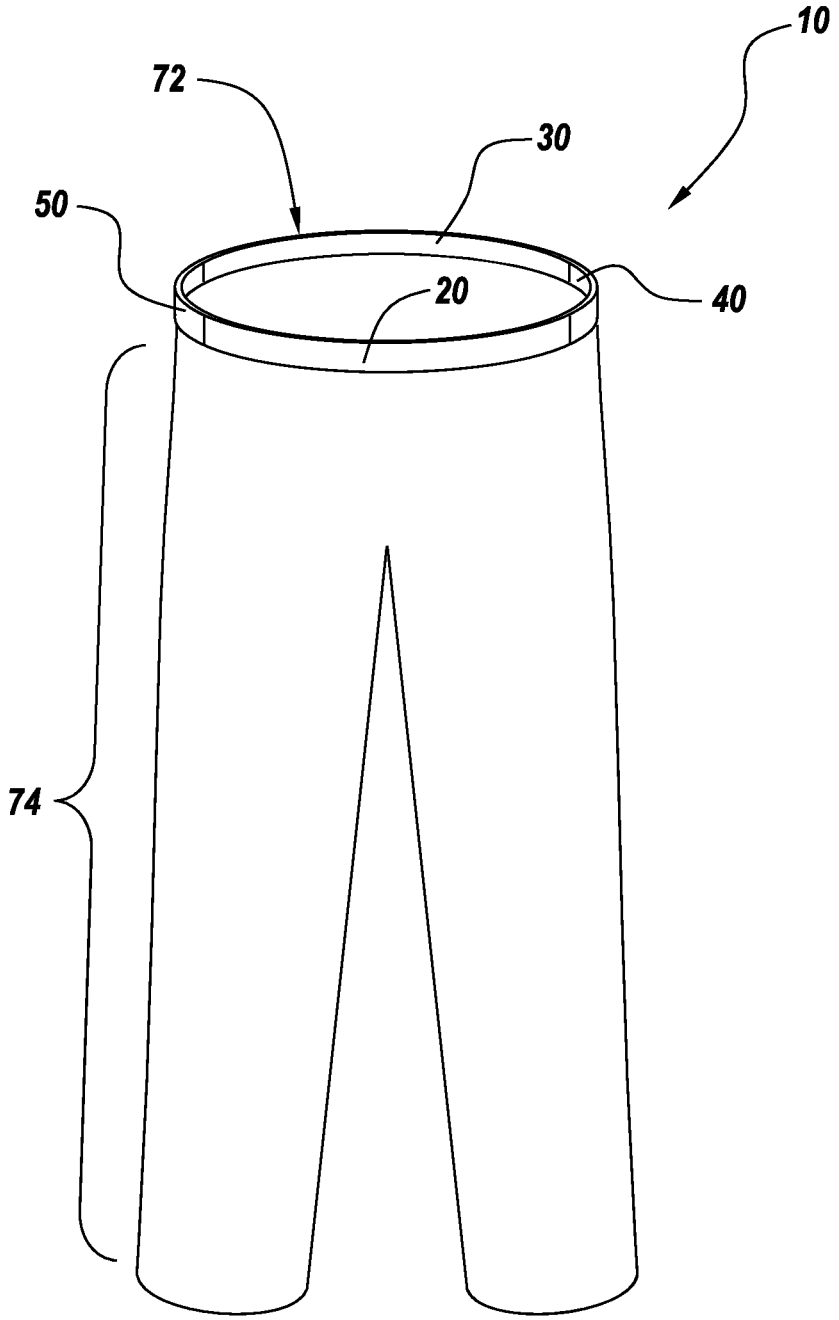
Figure 6C:
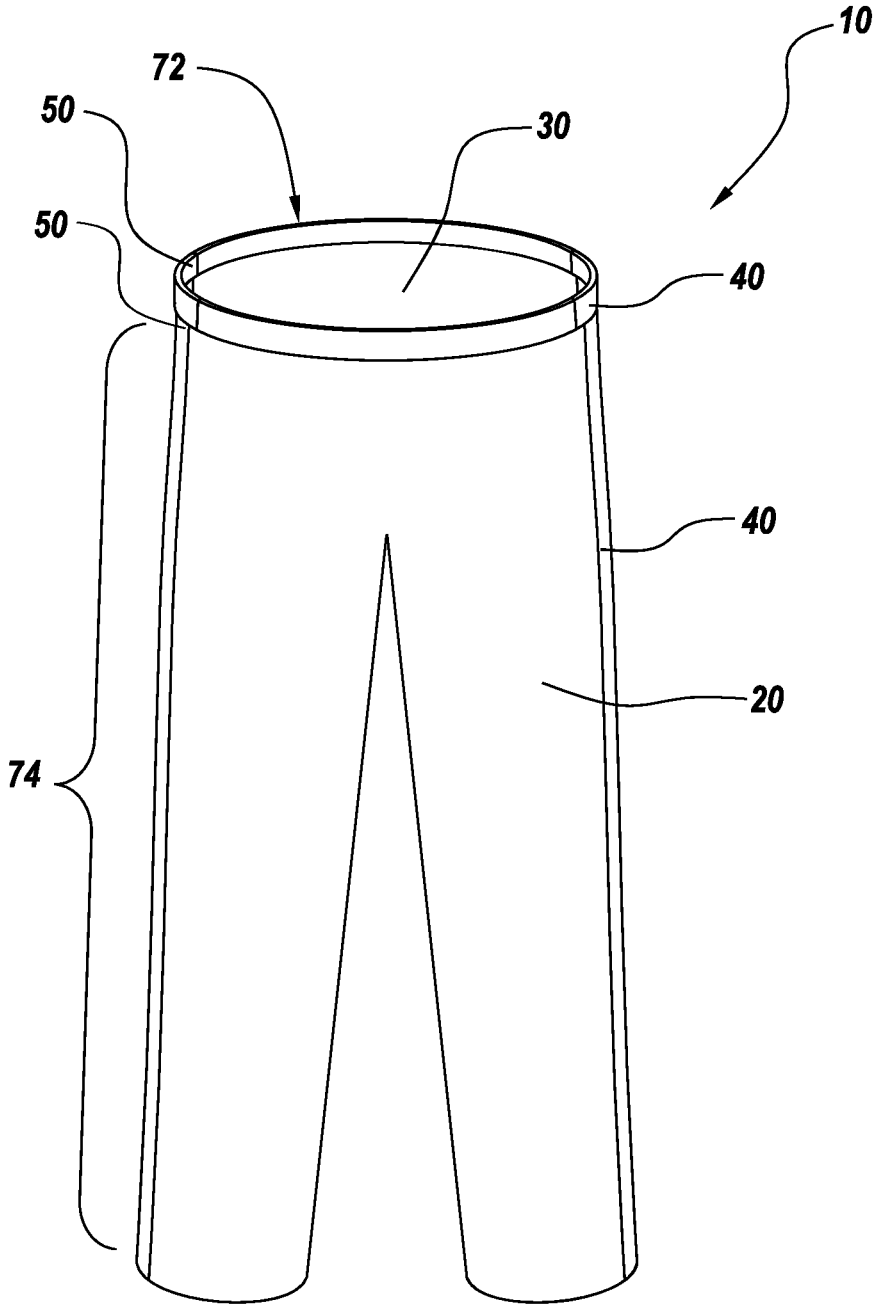

According to the embodiments shown in FIGS. 6A-6C, garment 10 includes a waistband portion 72 and a leg portion 74. As shown FIG. 6A, garment 10 includes a traditional waistband portion 72 (e.g., of traditional elastic or inelastic construction, etc.) with front panel 20, rear panel 30, left side panel 40, and right side panel 50 forming at least a portion of leg portion 74. As shown in FIG. 6B, garment 10 includes a traditional leg portion 74 (e.g., of traditional paneled construction, etc.) with front panel 20, rear panel 30, left side panel 40, and right side panel 50 forming at least a portion of waistband portion 72. As shown in FIG. 6C, both waistband portion 72 and leg portion 74 include a front panel 20, rear panel 30, left side panel 40, and right side panel 50. In embodiments where front panel 20, rear panel 30, left side panel 40, and right side panel 50 form at least a portion of leg portion 74, one or more additional panels of stretch material may couple front panel 20 and rear panel 30 along the inseam of leg portion 74. According to the embodiment shown in FIGS. 6D-6E, garment 10 is provided as part of a pair of shorts and includes front panel 20, rear panel 30, left side panel 40, right side panel 50, and additional fabric panels 80.

Figure 6D:
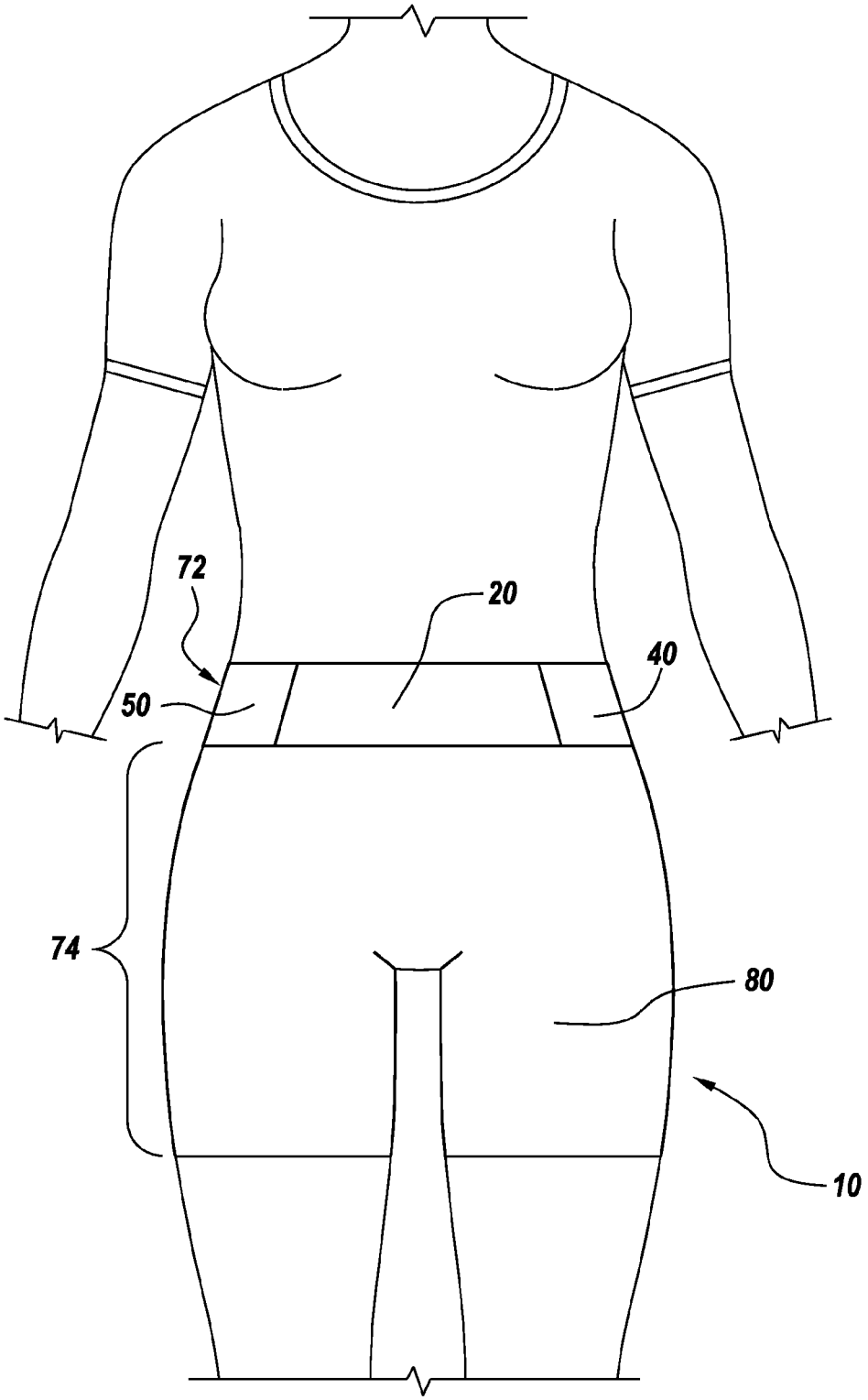
FIGS. 6D-6E are front and rear perspective views of a person wearing a multi-panel support garment provided as part of a pair of shorts, according to one embodiment.
Figure 6E:
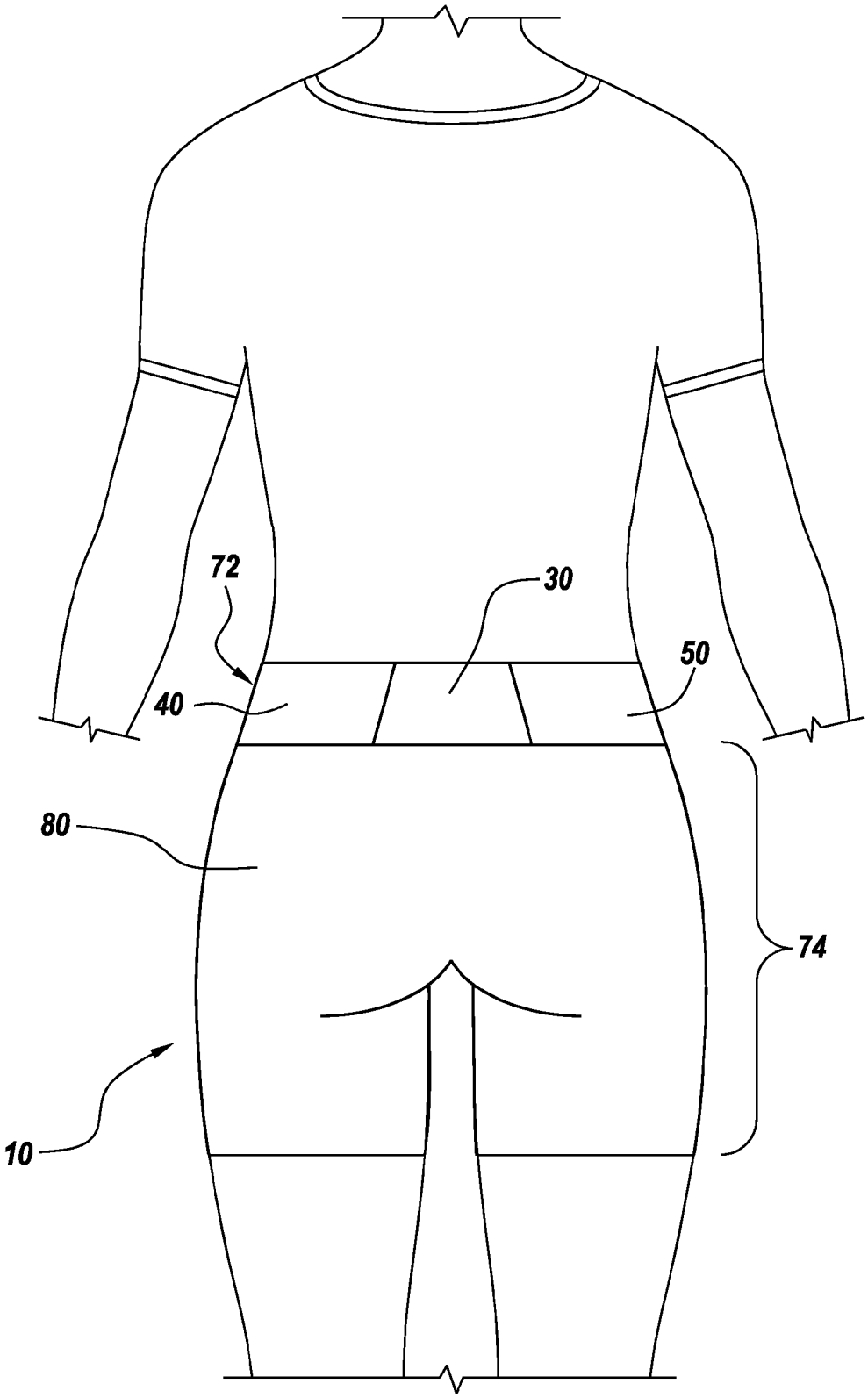
Figure 7A:
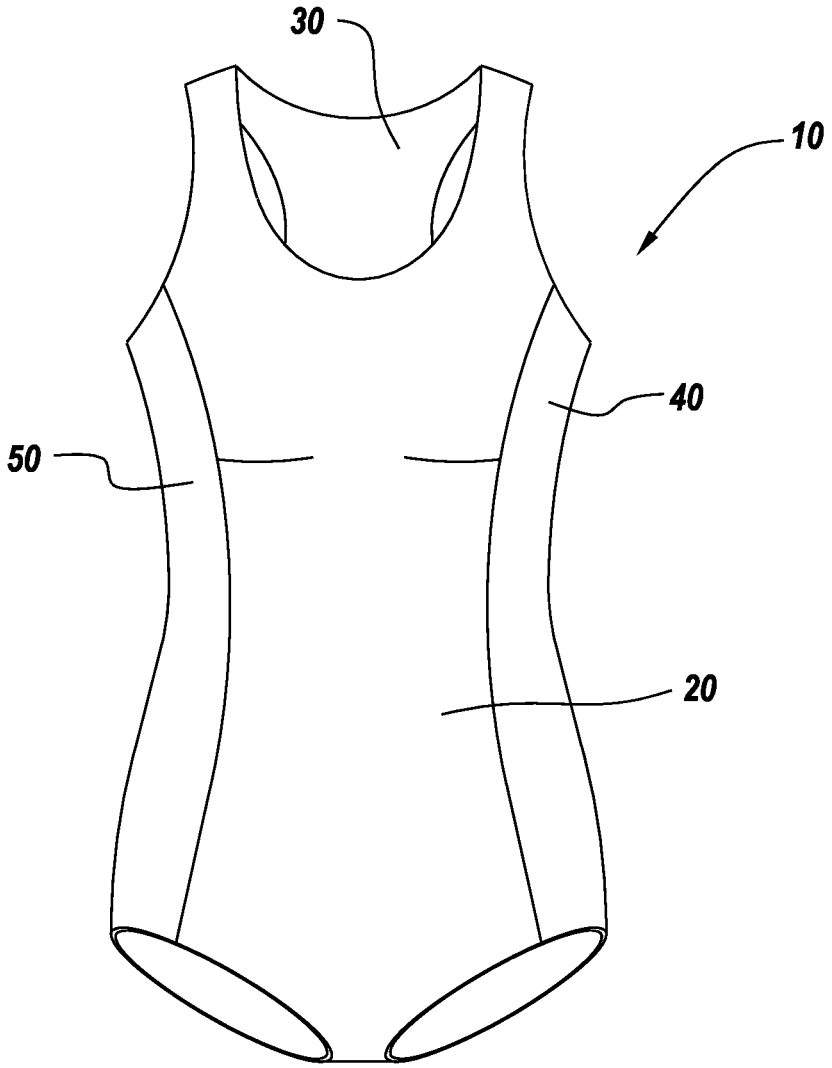
FIG. 7A is a front perspective view of a multi-panel support garment provided as part of a swimsuit, according to another embodiment.
Figure 7B:
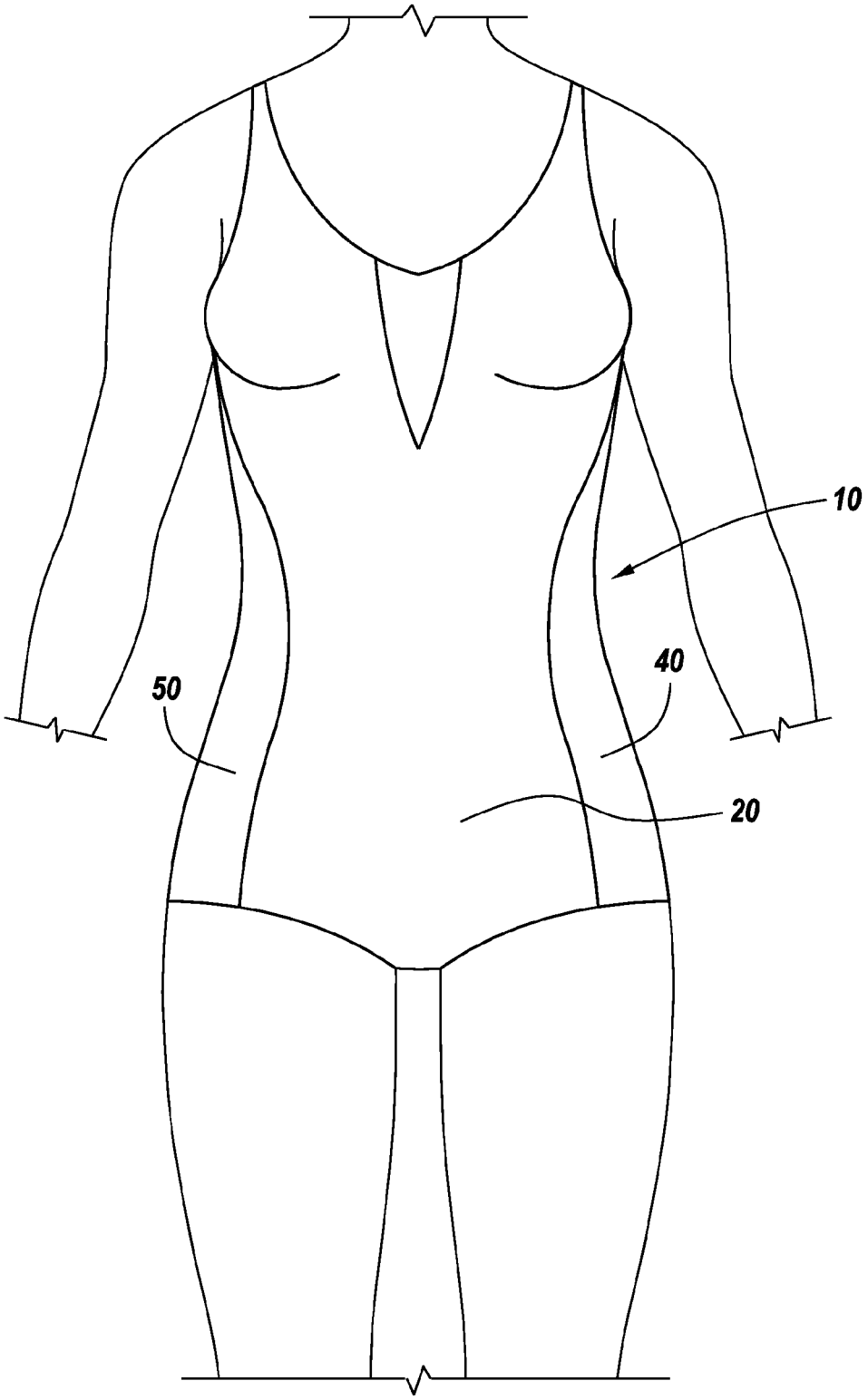
FIGS. 7B-7C are front and rear perspective views of a person wearing a multi-panel support garment provided as part of a swimsuit, according to another embodiment.
Figure 7C:
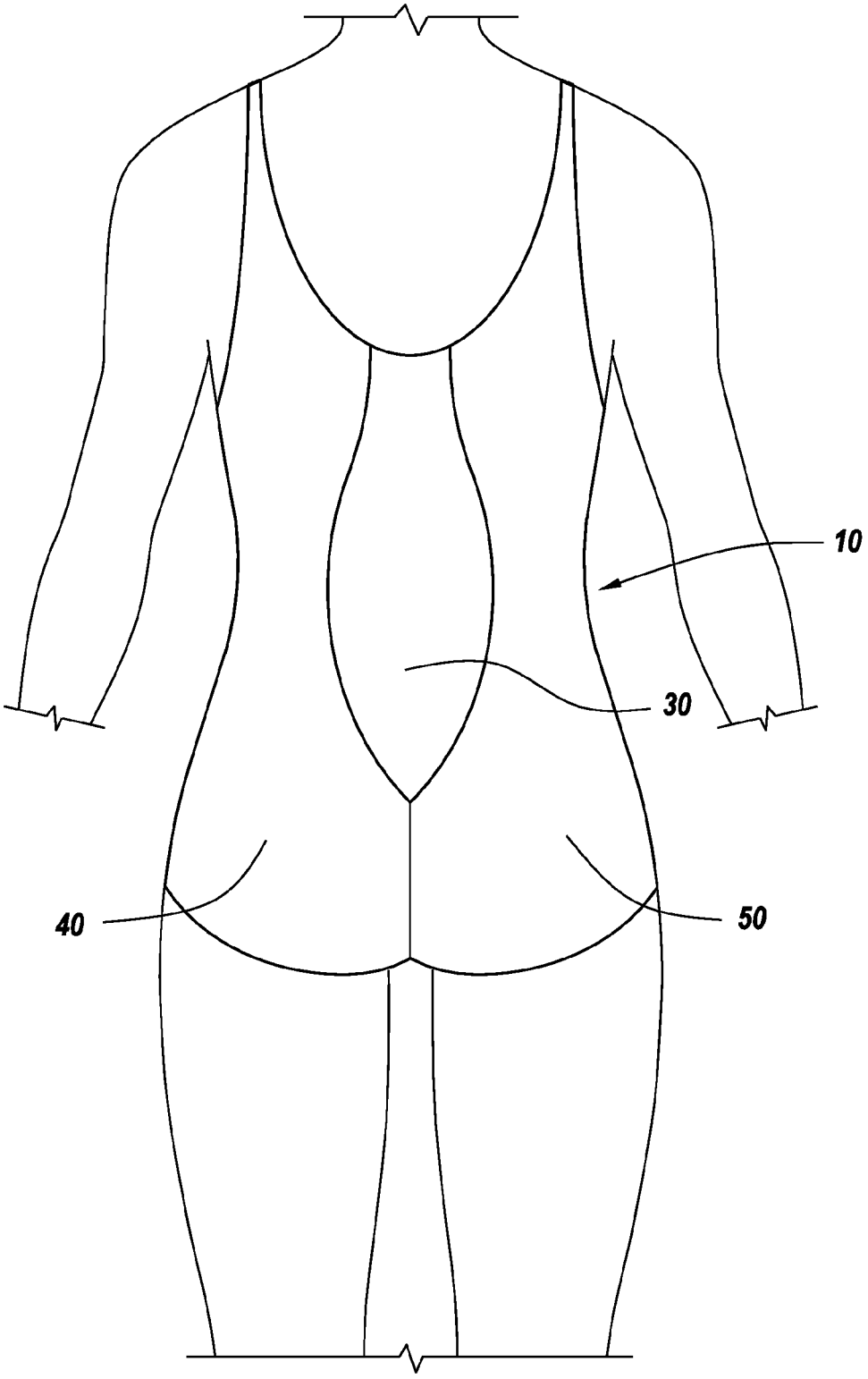
Figure 8A:
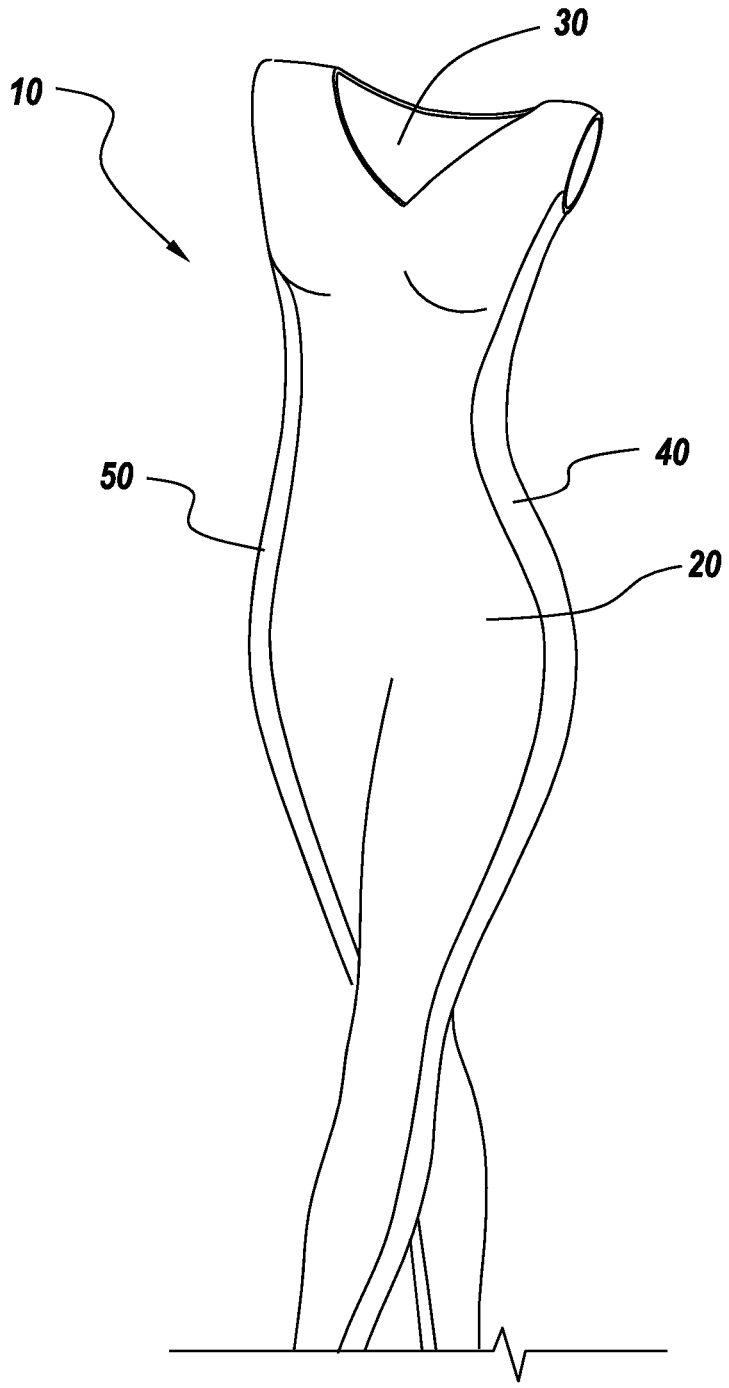
FIG. 8A is a front perspective view of a multi-panel support garment provided as part of a unitard, according to one embodiment.
Figure 8B:
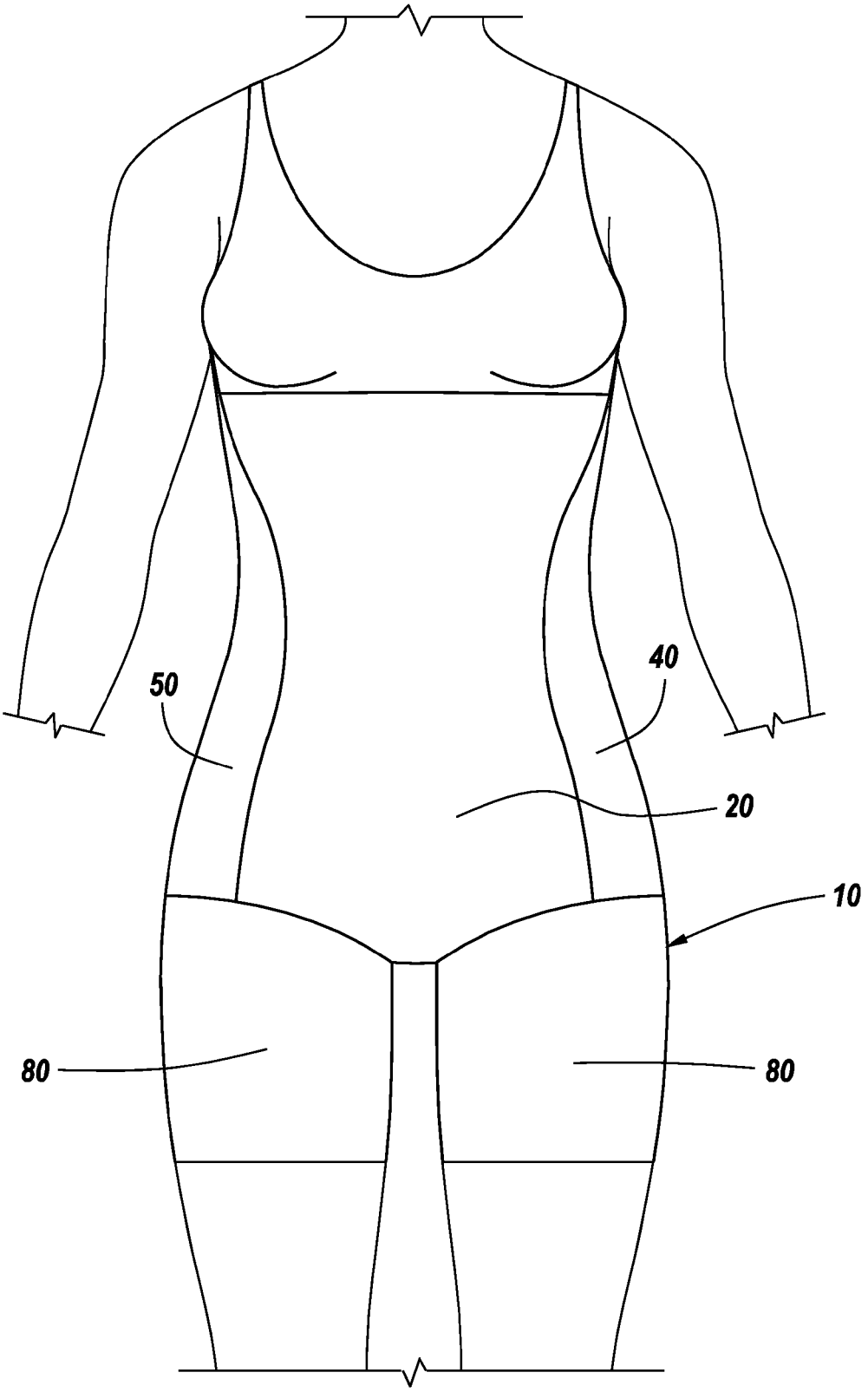
FIG. 8B is a front perspective view of a person wearing a multi-panel support garment provided as part of a unitard, according to another embodiment.
Figure 9A:
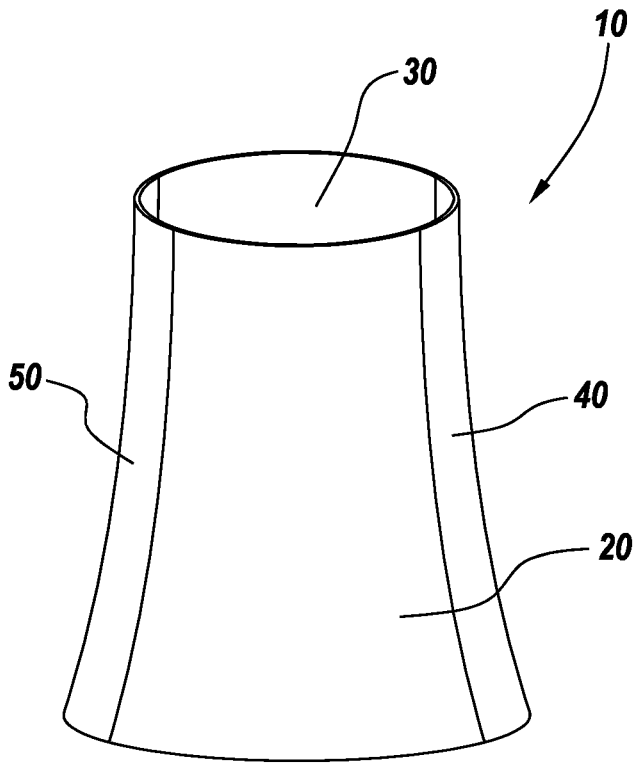
FIG. 9A is a front perspective view of a multi-panel support garment provided as part of a skirt, according to one embodiment.
Figure 9B:
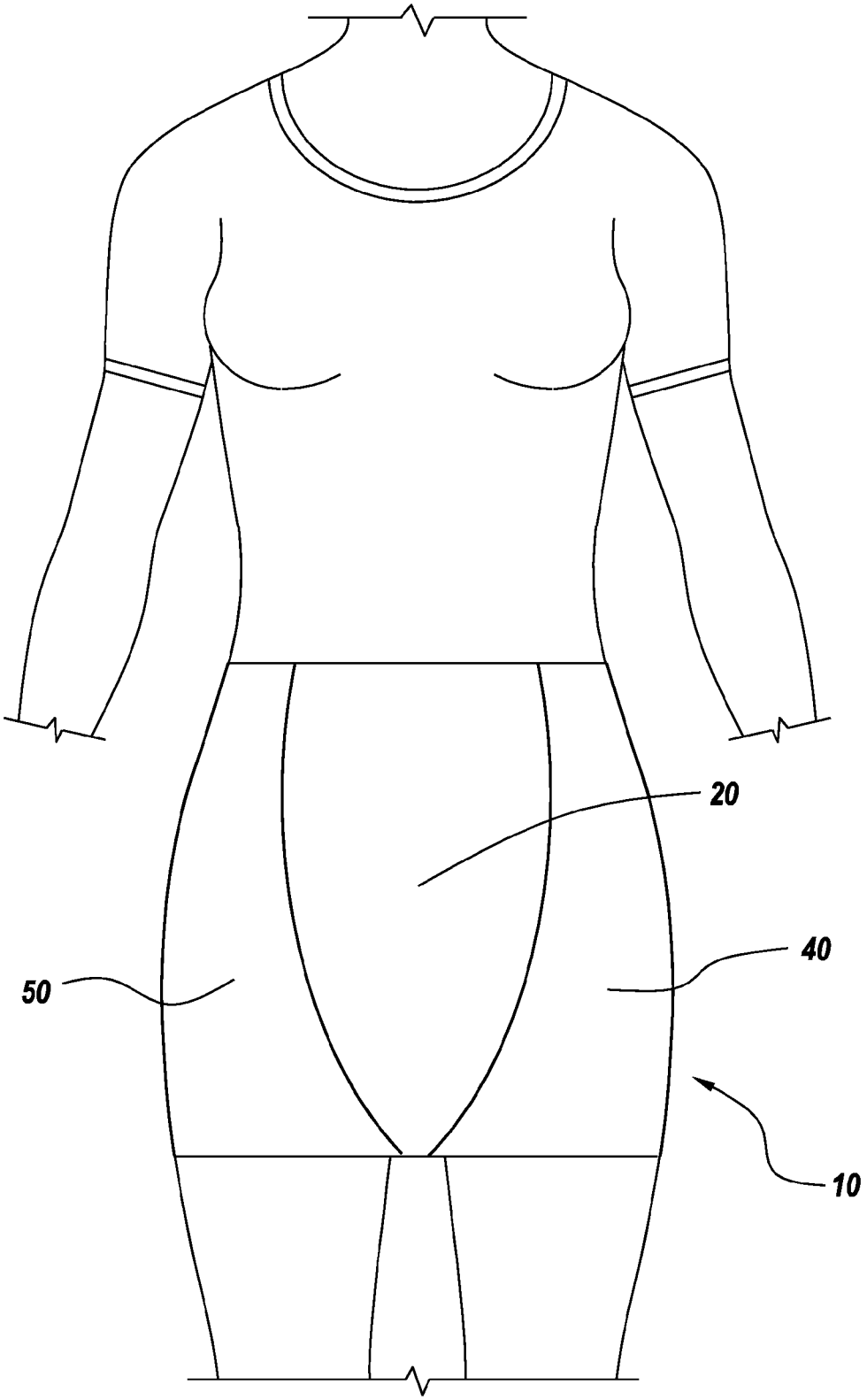
FIG. 9B is a front perspective view of a person wearing a multi-panel support garment provided as part of a skirt, according to another embodiment.
Figure 10A:
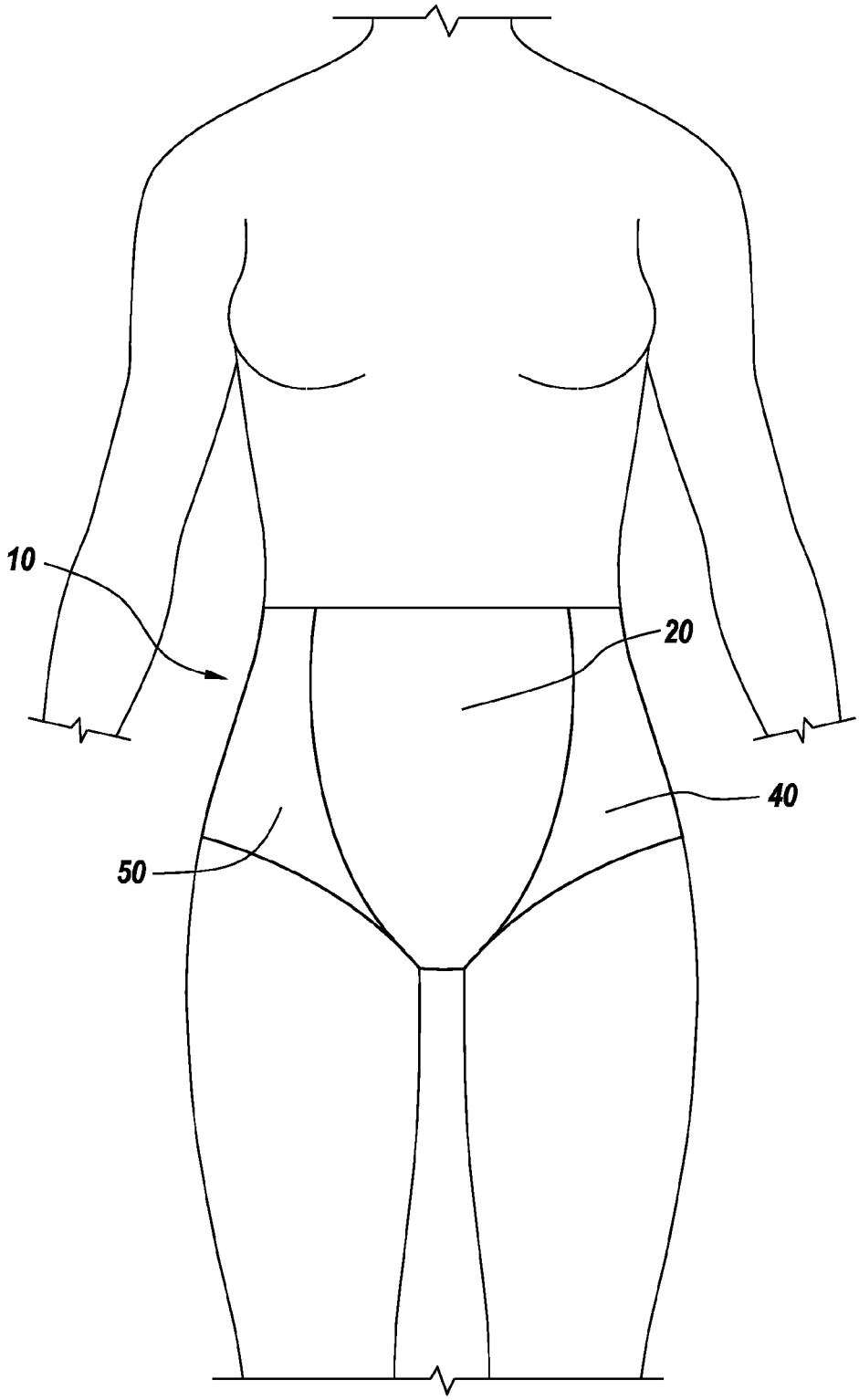
FIGS. 10A-10B are front and rear perspective views of a person wearing a multi-panel support garment provided as part of a pair of high-waist briefs, according to another embodiment.
Figure 10B:
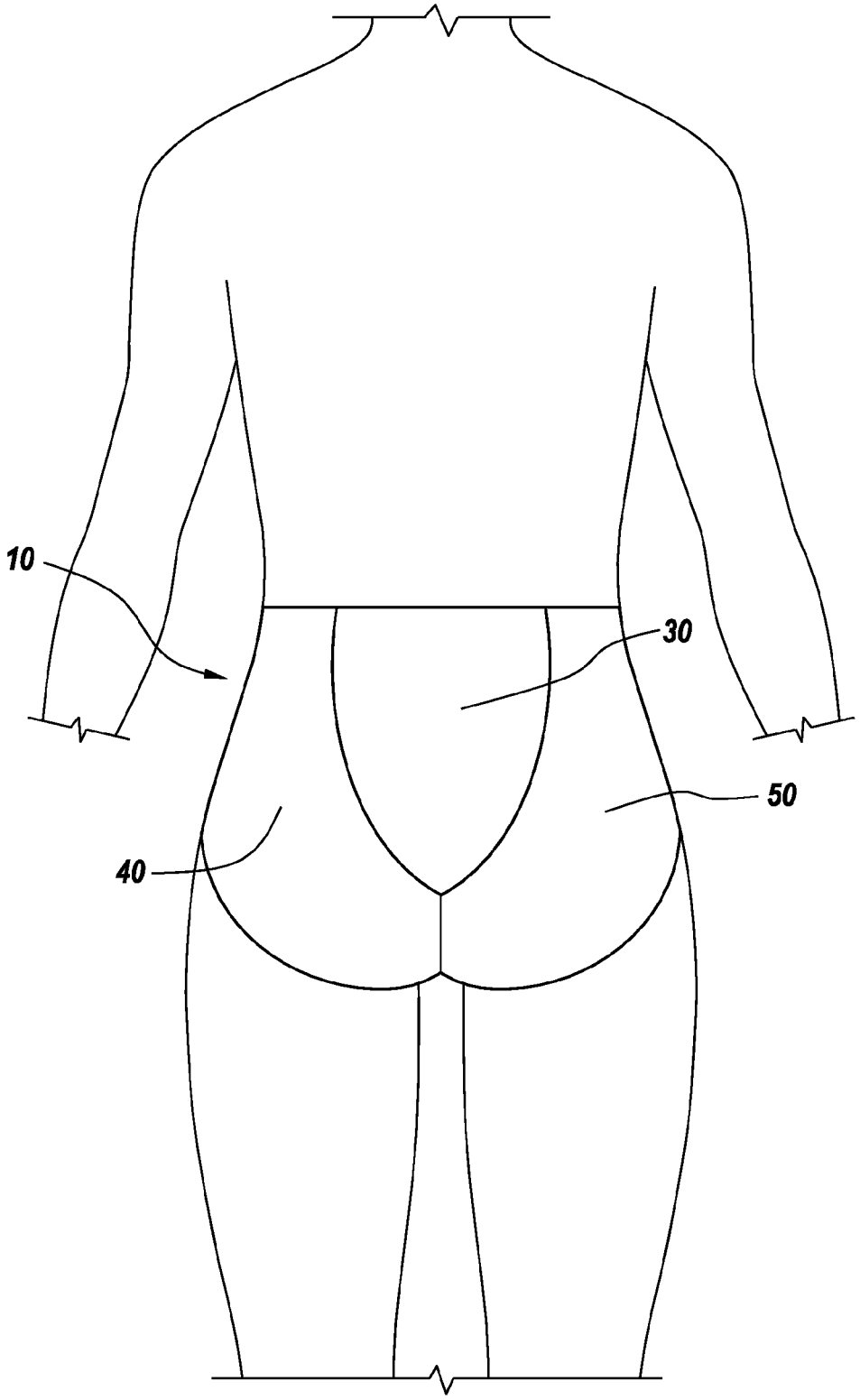

Referring again to the embodiments shown in FIGS. 6B-6E, front panel 20, rear panel 30, left side panel 40, and right side panel 50 are provided as part of waistband portion 72. By way of example, front panel 20, rear panel 30, left side panel 40, and right side panel 50 may be enclosed within a waistband of the pants (e.g., athletic pants, etc.). By way of another example, front panel 20, rear panel 30, left side panel 40, and right side panel 50 may be sewn into a waistband of the pants. As shown in FIGS. 6D-6E, front panel 20 and rear panel 30 have a trapezoidal shape. In one embodiment, front panel 20 and rear panel 30 are constructed of one or more contiguous pieces of a non-stretch fabric with the primary ease directions thereof oriented horizontally. Left side panel 40 and right side panel 50 may be constructed of one or more contiguous pieces of a stretch fabric with the primary stretch directions thereof oriented horizontally. According to one embodiment, the stretch fabrics include 25% elastic fibers. Garment 10 having front panel 20, rear panel 30, left side panel 40, and right side panel 50 provided as part of waistband portion 72 may slim the wearer's abdominal profile and provide the wearer with lower back support.

Figure 11:
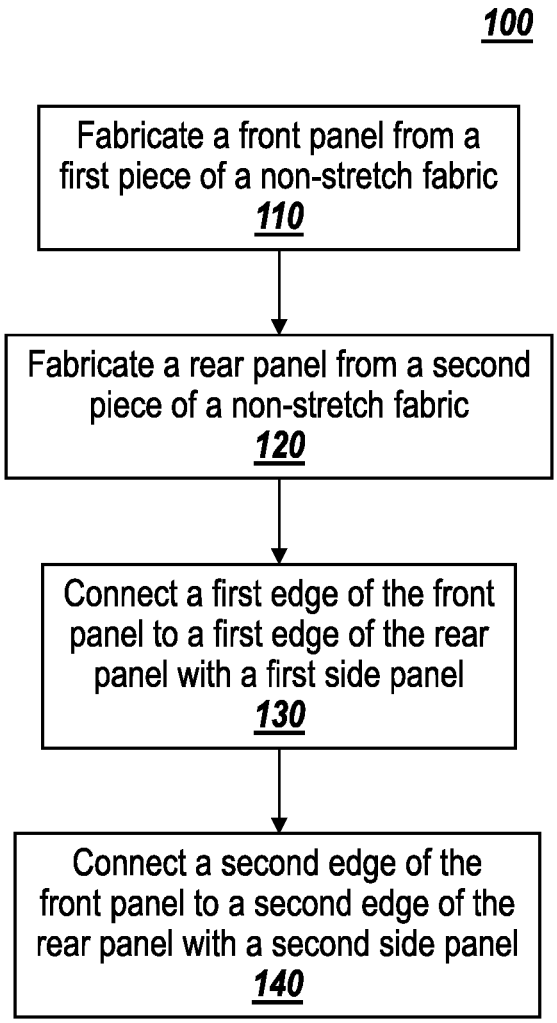
FIG. 11 is a flowchart depicting a method for making a multi-panel foundation support garment, according to one embodiment.

Referring next to the embodiment shown in FIG. 11, a multi-panel support foundation garment is constructed according to method 100. Method 100 includes fabricating a front panel from a first piece of a non-stretch fabric (110), fabricating a rear panel from a second piece of a non-stretch fabric (120), connecting a first edge of the front panel to a first edge of the rear panel with a first side panel (130), and connecting a second edge of the front panel to a second edge of the rear panel with a second side panel (140), according to the embodiment shown in FIG. 11. In one embodiment, fabricating the front panel and fabricating the rear panel includes fabricating the front panel from a first piece of a non-stretch fabric such that the front panel exhibits a larger degree of mechanical ease in a first direction than in a second direction and fabricating the rear panel from a second piece of a non-stretch fabric such that the rear panel exhibits a larger degree of mechanical ease in the first direction than in the second direction. The first side panel exhibits a larger degree of elastic stretch in the first direction than the second direction, and the second side panel exhibiting a larger degree of elastic stretch in the first direction than the second direction, according to one embodiment.

It is important to note that the construction and arrangement of the elements of the systems and methods as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the enclosure may be constructed from any of a wide variety of materials that provide sufficient strength or durability, in any of a wide variety of colors, textures, and combinations. Additionally, in the subject description, the word "exemplary" is used to mean serving as an example, instance, or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present inventions. The order or sequence of any process or method steps may be varied or re-sequenced according to alternative embodiments. Other substitutions, modifications, changes, and omissions may be made in the design, operating conditions, and arrangement of the preferred and other exemplary embodiments without departing from scope of the present disclosure or from the spirit of the appended claims.

Although the figures may show a specific order of method steps, the order of the steps may differ from what is depicted. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps, and decision steps.

What is claimed is:

1. A multi-panel support garment, comprising:

a front panel constructed of a first piece of fabric having a larger degree of mechanical ease in a first direction than a second direction;

a rear panel constructed of a second piece of fabric having a larger degree of mechanical ease in the first direction than the second direction;

a left side panel connecting a first edge of the front panel to a first edge of the rear panel, the left side panel constructed of a first piece of stretch fabric having a larger degree of elastic stretch in the first direction than the second direction; and a right side panel connecting a second edge of the front panel to a second edge of the rear panel, the right side panel constructed of a second piece of stretch fabric having a larger degree of elastic stretch in the first direction than the second direction.

2. The multi-panel support garment of claim 1, wherein the front panel comprises a substantially rectangular shape.

3. The multi-panel support garment of claim 1, wherein the front panel comprises a substantially curvilinear triangular shape.

4. The multi-panel support garment of claim 1, wherein the front panel comprises a substantially trapezoidal shape.

5. The multi-panel support garment of claim 1, wherein the front panel and the back panel comprises substantially the same shape.

6. The multi-panel support garment of claim 1, wherein at least 5% of the stretch fabric comprises elastic fibers.

7. The multi-panel support garment of claim 1, wherein no greater than 40% of the stretch fabric comprises elastic fibers.

8. The multi-panel support garment of claim 1, wherein the front panel comprises a plurality of layers of fabric.

9. The multi-panel support garment of claim 1, wherein the left side panel comprises spandex.

10. The multi-panel support garment of claim 1, wherein the left side panel comprises elastane.

11. The multi-panel support garment of claim 1, wherein the second direction is substantially perpendicular to the first direction.

12. A method for constructing a multi-panel support garment, comprising:

fabricating a front panel from a first piece of fabric such that the front panel exhibits a larger degree of mechanical ease in a first direction than a second direction;

fabricating a rear panel from a second piece of fabric such that the rear panel exhibits a larger degree of mechanical ease in the first direction than the second direction;

connecting a first edge of the front panel to a first edge of the rear panel with a first side panel exhibiting a larger degree of elastic stretch in the first direction than the second direction; and connecting a second edge of the front panel to a second edge of the rear panel with a second side panel exhibiting a larger degree of elastic stretch in the first direction than the second direction.

13. The method of claim 12, wherein fabricating the front panel exhibiting the larger degree of mechanical ease in the first direction than the second direction comprises layering a first piece of fabric having mechanical ease in the first direction with a second piece of fabric.

14. The method of claim 12, wherein fabricating the rear panel exhibiting the larger degree of mechanical ease in the first direction than the second direction comprises layering a first piece of fabric having mechanical ease in the first direction with a second piece of fabric.

15. The method of claim 12, wherein connecting the first edge of the front panel to the first edge of the rear panel with the first side panel comprises sewing the first side panel to the front panel.

16. The method of claim 12, wherein connecting the first edge of the front panel to the first edge of the rear panel with the first side panel comprises bonding the first side panel to the front panel using at least one of thermal bonding and adhesive bonding.

17. The method of claim 12, wherein connecting the first edge of the front panel to the first edge of the rear panel with the first side panel comprises ultrasonically seaming the first side panel to the front panel.

18. The method of claim 12, wherein connecting the first edge of the front panel to the first edge of the rear panel with the first side panel comprises bonding the first side panel to the rear panel using at least one of thermal bonding and adhesive bonding.

19. The method of claim 12, wherein connecting the first edge of the front panel to the first edge of the rear panel with the first side panel comprises ultrasonically seaming the first side panel to the rear panel.

20. A multi-panel support garment, comprising:

a front panel defining a longitudinal axis, the front panel comprising a first piece of fabric having a first primary ease direction, wherein the first piece of fabric is positioned such that the first primary ease direction extends laterally across the longitudinal axis;

a rear panel comprising of a second piece of fabric having a second primary ease direction, wherein the second piece of fabric is positioned such that the second primary ease direction extends laterally across the longitudinal axis; and a side panel coupling the front panel to the rear panel, the side panel comprising a first piece of stretch fabric having a primary stretch direction, wherein the first piece of stretch fabric is positioned such that the primary stretch direction extends laterally across the longitudinal axis.

* * * * *